US005669343A

United States Patent [19]

Adachi

[11] Patent Number: 5,669,343

[45] Date of Patent: Sep. 23, 1997

[54] VALVE TIMING CONTROL SYSTEM FOR INTERNAL COMBUSTION ENGINE

[75] Inventor: Michio Adachi, Oobu, Japan

[73] Assignee: Nippondenso Co., Ltd., Kariya, Japan

[21] Appl. No.: 644,942

[22] Filed: May 13, 1996

Related U.S. Application Data

[63] Continuation of Ser. No. 341,958, Nov. 16, 1994, abandoned.

[30] Foreign Application Priority Data

Nov. 16, 1993 [JP] Japan ..... 5-287082

[51] Int. Cl.[6] ..... F01L 1/34

[52] U.S. Cl. ..... 123/90.17; 123/90.31; 464/2; 137/625.69

[58] Field of Search ..... 123/90.12, 90.15, 123/90.17, 90.31; 464/1, 2, 160; 74/568 R; 137/625.69

[56] References Cited

U.S. PATENT DOCUMENTS

| | | | |
|---|---|---|---|
| 3,952,775 | 4/1976 | Ogata | 137/625.69 |
| 5,058,539 | 10/1991 | Saito et al. | 123/90.17 |
| 5,170,756 | 12/1992 | Szodfridt | 123/90.17 |
| 5,203,290 | 4/1993 | Tsuruta | 123/90.17 |
| 5,263,443 | 11/1993 | Schechter | 123/90.17 |
| 5,301,639 | 4/1994 | Satou | 123/90.17 |

FOREIGN PATENT DOCUMENTS

| | | |
|---|---|---|
| 1316582 | 12/1989 | Japan . |
| 2129477 | 5/1990 | Japan . |

*Primary Examiner*—Weilun Lo
*Attorney, Agent, or Firm*—Cushman, Darby & Cushman IP Group of Pillsbury Madison & Sutro, LLP

[57] ABSTRACT

A valve timing control system for an internal combustion engine includes a valve timing varying mechanism having a camshaft for driving an intake or exhaust valve, a hydraulic piston for varying an angular phase of the camshaft relative to an engine crankshaft, and valve timing advancing and retarding hydraulic pressure chambers for determining a position of the hydraulic piston. The valve timing control system further includes a control valve for controlling hydraulic pressures to be applied to the hydraulic pressure chambers. The control valve includes a sleeve and a spool slidably received in the sleeve. The sleeve is formed with a plurality of openings which, in cooperation with the spool, selectively establish and prohibit communication of the hydraulic pressure chambers relative to high and low pressure sides. Each of the openings is in the form of a groove and extends partially along the circumference of the sleeve. Arrangement of these openings is such that the adjacently arranged openings of at least one pair are offset relative to each other by 180 degrees in a circumferential direction of the sleeve and by a given small distance in an axial direction of the sleeve.

14 Claims, 7 Drawing Sheets

VALVE TIMING CONTROL SYSTEM FOR INTERNAL COMBUSTION ENGINE

This is a continuation of application Ser. No. 08/341,958, filed on Nov. 16, 1994, which was abandoned upon the filing hereof.

BACKGROUND OF THE INVENTION

1. Field of the Invention

The present invention relates to a valve timing control system for an internal combustion engine, which is capable of adjusting a phase relationship of valve opening timings between an intake valve and an exhaust valve in the engine so as to control a magnitude of a valve overlap of the intake and exhaust valves.

2. Description of the Prior Art

In the conventional valve timing control system for the engine, movement of a gear which is movably interposed between a timing pulley and a camshaft is controlled so as to cause a rotational displacement of the camshaft relative to the timing pulley to change a valve timing of an intake or exhaust valve.

Specifically, advancing and retarding hydraulic pressure chambers for the valve timing are formed at axially opposite sides of the gear, and hydraulic pressure supplying means supplies hydraulic oil into the hydraulic pressure chambers via a camshaft journal. By adjusting hydraulic pressures to be applied to the hydraulic pressure chambers, the gear is controlled to move in a desired direction between the timing pulley and the camshaft or to be stopped and held at a desired position. Accordingly, the valve timing is desirably controlled depending on a monitored operating condition of the engine.

In the foregoing conventional valve timing control system, the rotation of the timing pulley is transmitted to the camshaft via the gear having toothed portions on its inner and outer peripheries. As a result, a reaction force of driving torque of the camshaft is constantly exerted on the gear. On the other hand, a frictional force acts on the camshaft to constantly retard the camshaft relative to the rotation of the timing pulley. Accordingly, due to the reaction force from the camshaft, a force is exerted onto the gear so as to displace it in a direction to retard the valve timing.

For holding the valve timing at a desired timing, the gear is held at a desired position by adjusting the hydraulic pressures applied to the hydraulic pressure chambers. While the gear is held at the position, the hydraulic pressure in the advancing hydraulic pressure chamber tends to increase due to the foregoing force exerted onto the gear to retard the valve timing. This may cause the hydraulic oil in the advancing hydraulic pressure chamber to leak out so that an amount of the hydraulic oil in the advancing hydraulic pressure chamber is reduced. This reduction in oil amount causes displacement of the gear so that the gear can not be held at the desired position. The reduction in oil amount further causes delay in movement of the gear during the advancing or retarding operation of the valve timing so that the response characteristic of the valve timing control becomes poor.

On the other hand, a control valve of a type having a sleeve and a spool slidably received in the sleeve is available for controlling the supply of the hydraulic oil to the hydraulic pressure chambers. In case of the sleeve having, for example, five ports for connection to a pump, to the advancing hydraulic pressure chamber, to its drain, to the retarding hydraulic pressure chamber and to its drain, an axial length of the sleeve inevitably becomes long since the ports should be arranged in positions along the axis of the sleeve with given axial intervals therebetween. This makes it difficult to machine a center bore for receiving the spool, the ports in the form of grooves and others with high accuracy. On the other hand, for reducing pressure loss at the ports as much as possible, diameters of associated hydraulic passages should be large enough, and thus widths of the port grooves should also be large enough to correspond to the diameters of the associated hydraulic passages. Accordingly, in order to reduce the axial length of the sleeve, it is necessary to reduce the axial intervals between the port grooves. This results in poor sealing to allow the foregoing leakage of the hydraulic oil, and thus should be avoided.

SUMMARY OF THE INVENTION

Therefore, it is an object of the present invention to provide an improved valve timing control system for an internal combustion engine.

According to one aspect of the present invention, a valve timing control system for an internal combustion engine comprises a camshaft for driving at least one of intake and exhaust valves of the engine; camshaft driving means provided between a crankshaft of the engine and the camshaft for synchronously transmitting torque from the engine crankshaft to the camshaft the camshaft driving means including phase varying means for changing an angular phase of the camshaft relative to the engine crankshaft; driving means for the phase varying means, having at least one hydraulic pressure chamber for moving the phase varying means due to a hydraulic pressure in the hydraulic pressure chamber to force a rotational displacement of the camshaft relative to the engine crankshaft; and a control valve having a sleeve and a spool received in said sleeve, the sleeve having a plurality of openings arranged in an axial direction of the sleeve and communicating with the hydraulic pressure chamber, a high-pressure side and a low-pressure side, respectively, at least one pair of the adjacently arranged openings being offset relative to each other in a circumferential direction of the sleeve; and the spool being slidable in the axial direction of the sleeve and having a plurality of lands for selectively opening and closing the openings so as to control the hydraulic pressure in the hydraulic pressure chamber.

According to another aspect of the present invention, a valve timing control system for an internal combustion engine comprises a camshaft for driving at least one of intake and exhaust valves of the engine; camshaft driving means provided between a crankshaft of the engine and the camshaft for synchronously transmitting torque from the engine crankshaft to the camshaft the camshaft driving means including phase varying means for changing an angular phase of the camshaft relative to the engine crankshaft; driving means for the phase varying means, having an advancing hydraulic pressure chamber for moving the phase varying means due to a hydraulic pressure in the advancing hydraulic pressure chamber to rotate the camshaft relative to the engine crankshaft so as to advance a valve timing of the at least one of intake and exhaust valves, the driving means for the phase varying means further having a retarding hydraulic pressure chamber for moving the phase varying means due to a hydraulic pressure in the retarding hydraulic pressure chamber to rotate the camshaft relative to the engine crankshaft so as to retard the valve timing of the at least one of intake and exhaust valves; and a control valve having a sleeve and a spool received in the sleeve, the sleeve having a plurality of openings arranged in an axial direction of the sleeve and communicating with the advancing hydraulic pressure chamber, the retarding hydraulic pressure chamber, a high-pressure side and a low-pressure side, respectively, at least one pair of the adjacently arranged openings being offset relative to each other in a circumferential direction of the sleeve; and the spool being slidable in the axial direction of the sleeve and having a plurality of lands for selectively opening and closing the openings so as to control the hydraulic pressures in the advancing and retarding hydraulic pressure chambers.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENT

Now, preferred embodiments of the present invention will be described hereinbelow with reference to the accompanying drawings.

Figure 1:
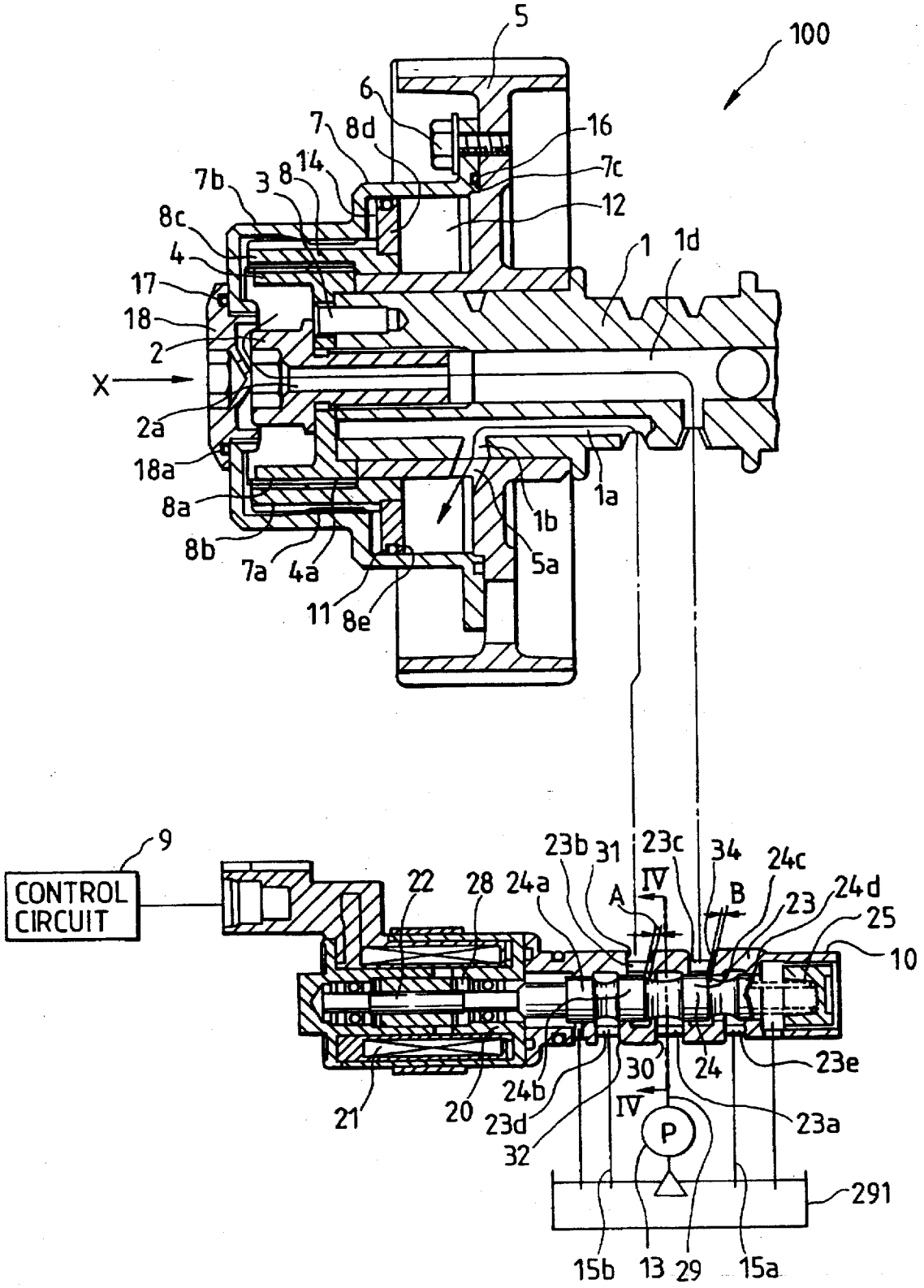
FIG. 1 is a sectional view showing a valve timing control system for an internal combustion engine according to a first preferred embodiment of the present invention, wherein a hydraulic piston is controlled to a position to most retard a valve timing of an intake or exhaust valve.
Figure 2:
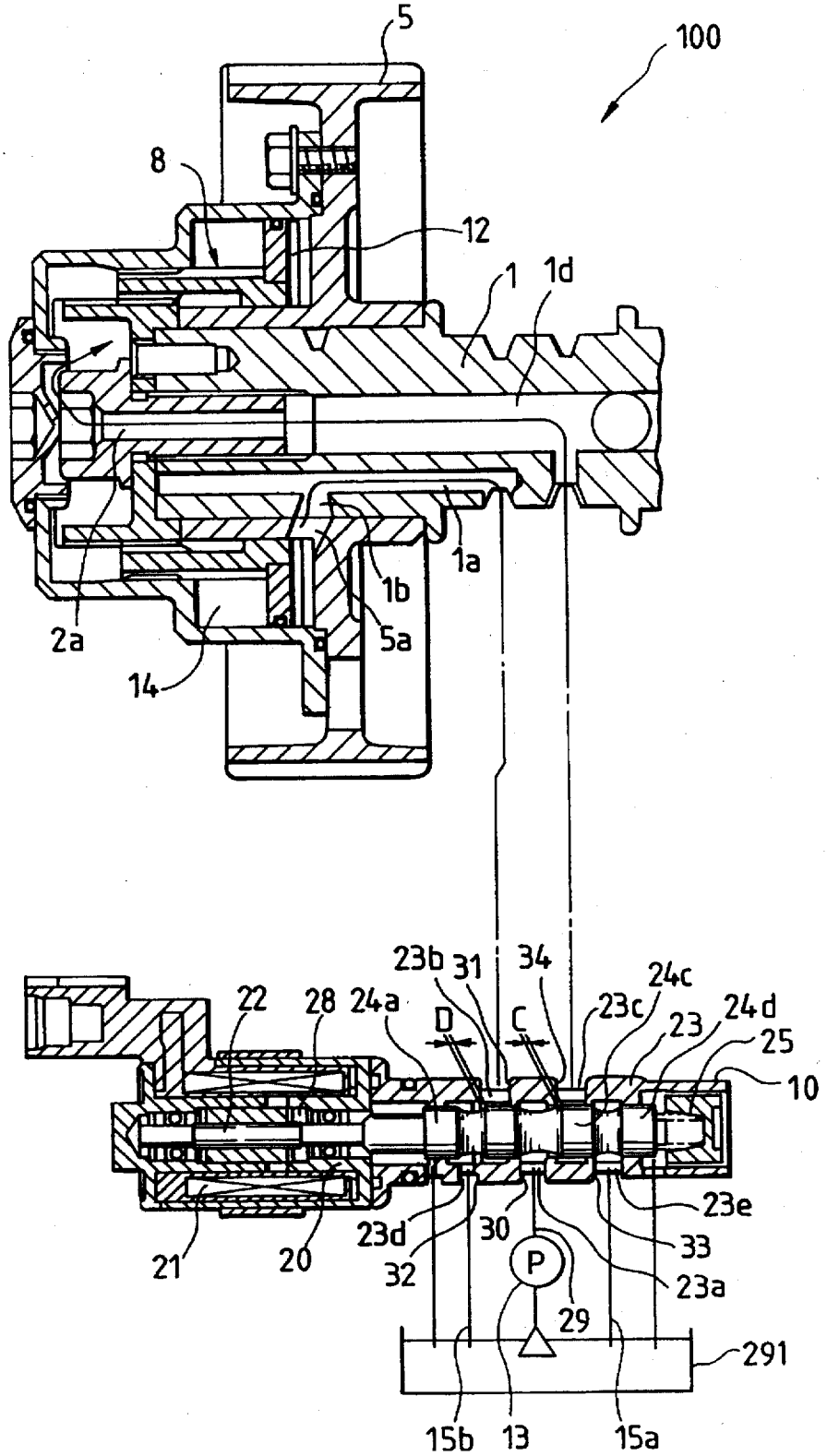
FIG. 2 is a sectional view showing the valve timing control system according to the first preferred embodiment, wherein the hydraulic piston is controlled to a position to most advance the valve timing of the intake or exhaust valve.
Figure 3:
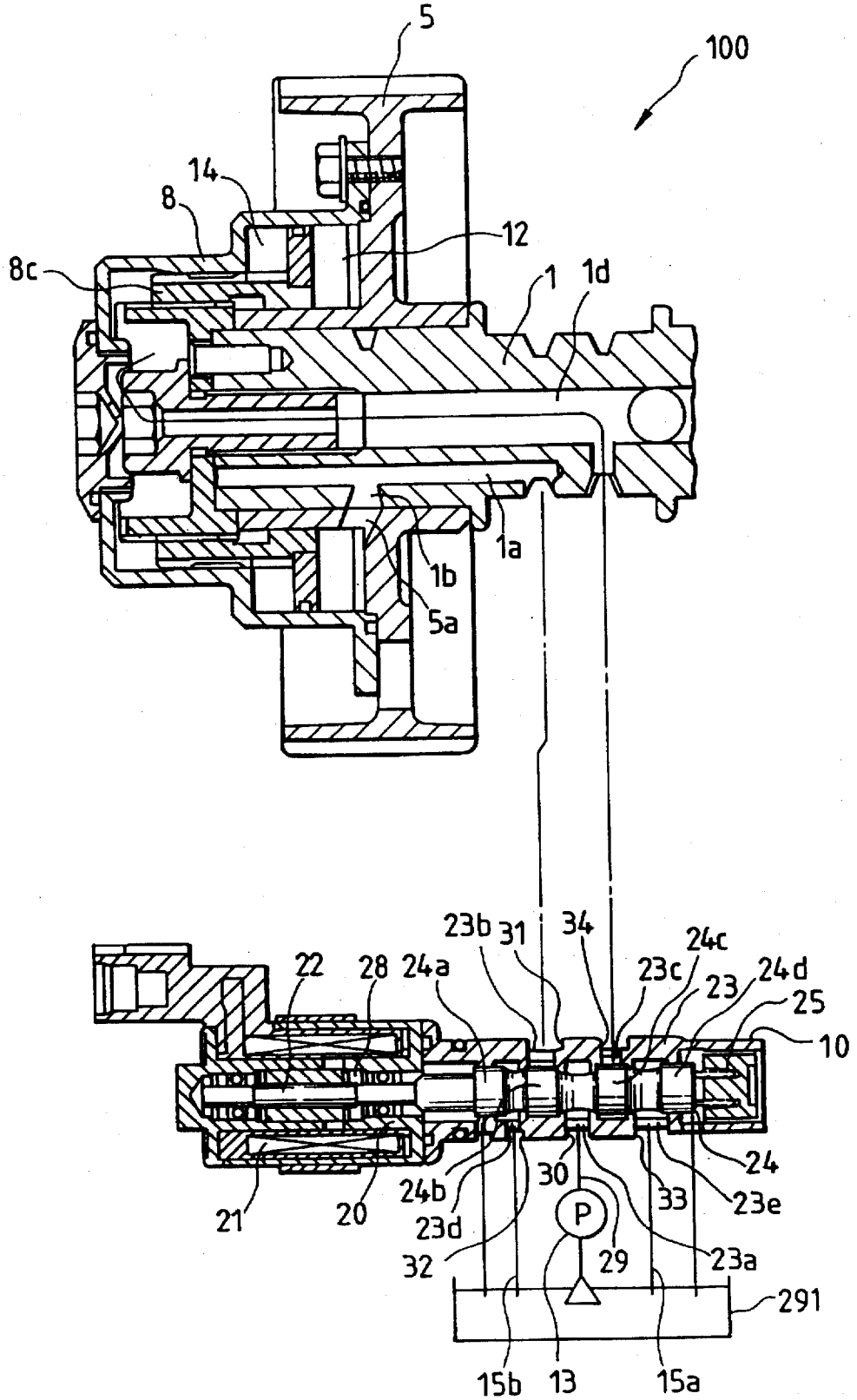
FIG. 3 is a sectional view showing the valve timing control system according to the first preferred embodiment, wherein the hydraulic piston is held at an intermediate position to provide the valve timing of the intake or exhaust valve at an intermediate value.

FIGS. 1 to 3 are sectional views, respectively, of a valve timing control system for an internal combustion engine according to a first preferred embodiment of the present invention.

In these figures, the valve timing control system includes a valve timing varying mechanism 100 and a control valve 10. The valve timing varying mechanism 100 includes a timing pulley 5, as a component on a side of an engine crankshaft (not shown), which is driven by a timing belt transmitting power or torque of the engine crankshaft, so as to rotate in synchronism with the engine crankshaft. The valve timing varying mechanism 100 further includes a camshaft 1 which is arranged to rotate in synchronism with the rotation of the timing pulley 5 so as to actuate an intake or exhaust valve (not shown) through a cam (not shown) fixed onto the camshaft 1. The timing pulley 5 and the camshaft 1 are arranged to rotate in a clockwise direction as seeing along a direction X in FIG. 1 (hereinafter, this clockwise direction will be referred to as "valve timing advancing direction", and a direction opposite thereto will be referred to as "valve timing retarding direction").

A camshaft sleeve 4 of an essentially cylindrical shape, as a component on a side of the camshaft 1, is fixed to one end of the camshaft 1 by means of a pin 3 and a bolt 2 for co-rotation or synchronous rotation with the camshaft 1. On a portion of an outer periphery of the camshaft sleeve 4 are formed outer helical teeth or splines 4*a*.

The timing pulley 5 is mounted on the camshaft 1 so as to be rotatable relative to the camshaft 1. On the other hand, the timing pulley 5 is prohibited from moving axially along the camshaft 1 due to abutment of its hub portion against an axial end of the camshaft sleeve 4 and against an annular projection of the camshaft 1 between which the hub portion of the timing pulley 5 is interposed. A sprocket sleeve 7 of a stepped cylindrical shape is fixed to the timing pulley 5 by means of bolts 6. On a surface of the sprocket sleeve 7 receiving the bolts 6 therethrough and abutting against the timing pulley 5 is formed an annular groove 7*c* which receives therein an O-ring 16 for sealing to ensure a fluid-tight condition.

A small-diameter portion 7*b* of the sprocket sleeve 7 confronts the camshaft sleeve 4 with a predetermined radial gap therebetween. On a portion of an inner periphery of the small-diameter portion 7*b* are formed inner helical teeth or splines 7*a*. The inner helical splines 7*a* have a helix angle which is opposite to the foregoing outer helical splines 4*a*. On the other hand, either one of the outer helical splines 4*a* and the inner helical splines 7*a* may have a helix angle of 0 (zero), that is, may be formed as straight teeth or splines extending axially in parallel.

A hydraulic piston 8 in the form of a gear of an essentially cylindrical shape is disposed in the foregoing radial gap between the camshaft sleeve 4 and the small-diameter portion 7*b* of the sprocket sleeve 7. The hydraulic piston 8 is movable in the axial direction of the camshaft 1.

The hydraulic piston 8 includes a cylindrical section 8*c* and a disk section 8*d* formed with a central mounting opening which receives an end of the cylindrical section 8*c* in a press-fit manner. The cylindrical section 8*c* is slidably fitted over the hub portion of the timing pulley 5. On a portion of an inner periphery of the cylindrical section 8*c* are formed inner helical teeth or splines 8*a* which mesh with the outer helical splines 4*a* of the camshaft sleeve 4. Similarly, on a portion of an outer periphery of the cylindrical section 8*c* are formed outer helical teeth or splines 8*b* which mesh with the inner helical splines 7*a* of the sprocket sleeve 7. Through the meshing engagement of the foregoing splines, the rotational motion of the timing pulley 5 is transmitted to the camshaft 1 via the sprocket sleeve 7, the hydraulic piston 8 and the camshaft sleeve 4.

In this preferred embodiment, the helix angles of the helical splines are set so as to advance a valve timing of the intake or exhaust valve in response to rightward movement of the hydraulic piston 8 in FIG. 1. On an outer periphery, abutting with an inner periphery of a large-diameter portion of the sprocket sleeve 7, of the disk section 8*d* of the hydraulic piston 8 is formed an annular groove 8*e* which receives therein a piston ring 11 for sealing to ensure a fluid-tight condition. The hydraulic piston 8 divides an interior space defined by the timing pulley 5 and the sprocket sleeve 7 into two hydraulic pressure chambers, that is, one being an advancing hydraulic pressure chamber 14 formed on a left side of the hydraulic piston 8 in the figure and the other being a retarding hydraulic pressure chamber 12 formed on a right side of the hydraulic piston 8 in the figure. Further, the sprocket sleeve 7 is formed at its left end in the figure with a threaded opening which fixedly receives a bolt 18 in a screwed manner. The bolt 18 is formed with an annular groove 18*a* which receives therein an O-ring 17 for sealing to ensure a fluid-tight condition.

A hydraulic passage 2*a* is formed extending axially through the bolt 2 mounted to the camshaft 1. The hydraulic passage 2*a* has one end which opens to the advancing hydraulic pressure chamber 14 and the other end which communicates with a central axial hydraulic passage 1*d*. Accordingly, the hydraulic passage 1*d* communicates with the advancing hydraulic pressure chamber 14 via the hydraulic passage 2*a*.

The camshaft 1 is further formed with a hydraulic passage 1*a* which communicates with an annular groove 1*b* formed around the camshaft 1. The annular groove 1*b* communicates, in turn, with a hydraulic passage 5*a* formed in the timing pulley 5, and then, the hydraulic passage 5*a* opens to the retarding hydraulic pressure chamber 12. Accordingly, the hydraulic passage 1*a* communicates with the retarding hydraulic pressure chamber 12 via the annular groove 1*b* and the hydraulic passage 5*a*.

The hydraulic passages 1*a* and 1*d* formed in the camshaft 1 are respectively connected to the control valve 10. Further, a hydraulic pressure feeding passage 29 and two hydraulic pressure releasing or draining passages 15*a* and 15*b* are connected to the control valve 10. The hydraulic pressure feeding passage 29 works to supply a hydraulic oil in a oil pan 291 into the control valve 10 via an oil pump 13 which pressurizes the hydraulic oil fed from the oil pan 291. On the other hand, the hydraulic pressure draining passages 15*a* and 15*b* return the hydraulic oil to the oil pan 291, respectively.

Now, a structure of the control valve 10 will be described hereinbelow in detail.

A yoke 20 of an essentially cylindrical shape is formed of a magnetic material and includes therein a coil 21 and a bar-like moving core 22 which is slidable in the yoke 20.

A cylindrical sleeve 23 is fixed to one end of the yoke 20. The sleeve 23 is formed at its predetermined axial positions with a plurality of openings 23*a*, 23*b*, 23*c*, 23*d* and 23*e*. The opening 23*a* communicates with the hydraulic pressure feeding passage 29, the opening 23*b* with the hydraulic passage 1*a*, the opening 23*c* with the hydraulic passage 1*d*, the opening 23*d* with the hydraulic pressure draining passage 15*b*, and the opening 23*e* with the hydraulic pressure draining passage 15*a*.

Figure 4:
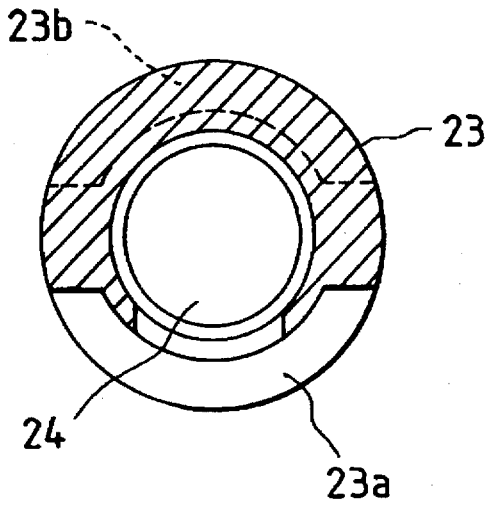
FIG. 4 is a sectional view taken along line IV—IV in FIG. 1.
Figure 5:
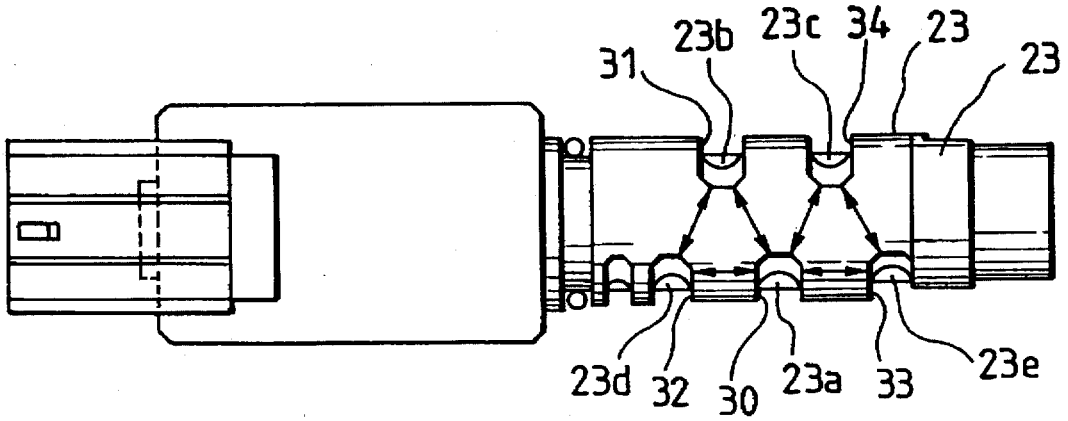
FIG. 5 is a diagram for explaining sealing lengths of sealing portions between associated openings of a sleeve of a control valve according to the first preferred embodiment.

Each of the openings 23*a* to 23*e* is circumferentially formed in a wall of the sleeve 23 and extends partially along the circumference of the wall of the sleeve 23. A cross-section of the opening 23*a* is shown in FIG. 4 which is a sectional view taken along line IV—IV in FIG. 1. As seen from FIG. 4, the opening 23*a* is in the form of a groove extending partially along the circumference of the sleeve 23. Similarly, each of the openings 23*b* to 23*e* is in the form of a groove extending partially along the circumference of the sleeve 23. Arrangement of these openings 23*a* to 23*e* is shown in FIG. 5. Specifically, each of the openings 23*a* to 23*e* is offset relative to the corresponding adjacent opening by 180 degrees in the circumferential direction of the sleeve 23 and by a predetermined small distance in the axial direction of the sleeve 23, so as to ensure necessary sealing lengths of sealing portions formed between the openings as represented by arrows in FIG. 5, while reducing the axial length of the sleeve 23.

Figure 6:
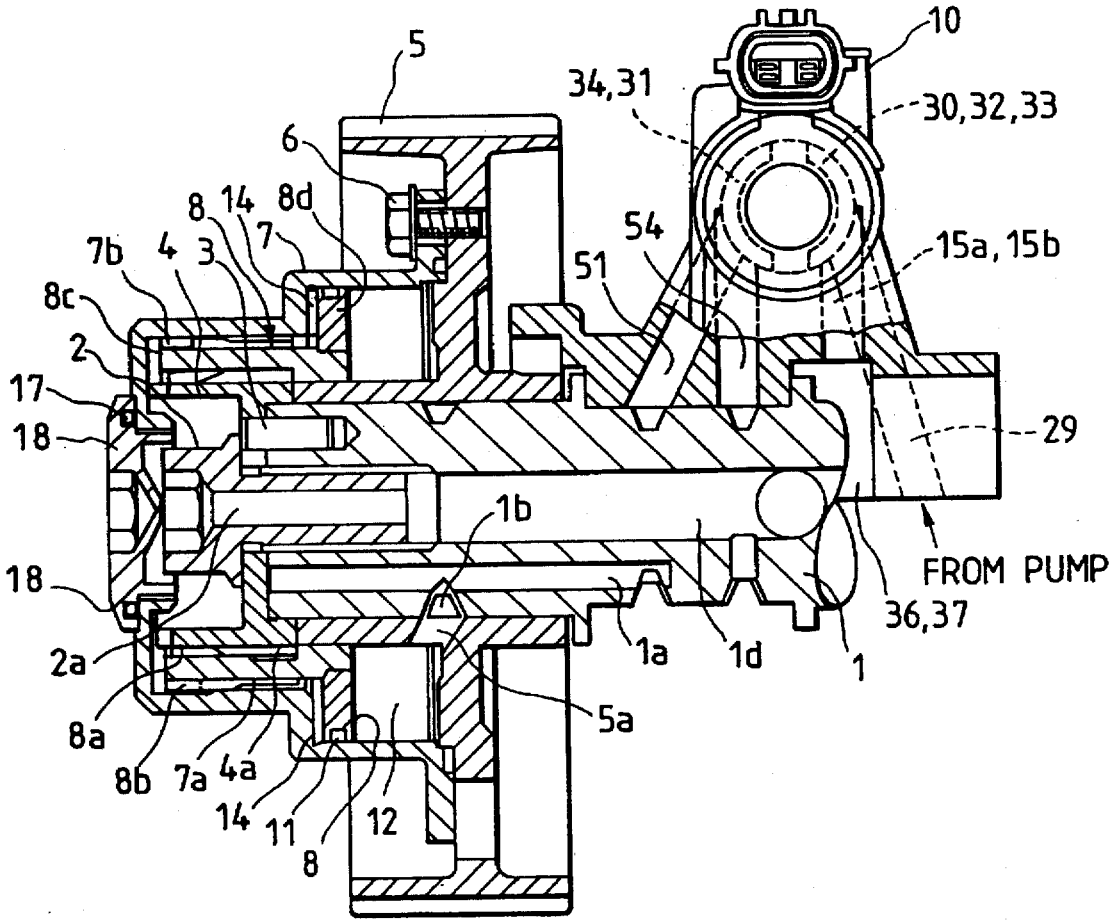
FIG. 6 is a sectional view of the valve timing control system according to the first preferred embodiment, for particularly explaining a positional relationship of the openings of the control valve relative to associated hydraulic passages.

The openings 23*a*, 23*b*, 23*c*, 23*d* and 23*e* are formed by grooves 30, 31, 34, 32 and 33, respectively. In this preferred embodiment, as shown in FIG. 6, the groove 34 and a passage 54 for connection between the groove 34 and the hydraulic passage 1*d* (the advancing hydraulic pressure chamber 14), and the groove 31 and a passage 51 for connection between the groove 31 and the hydraulic passage 1*a* (the retarding hydraulic pressure chamber 12) are arranged on a left side in the figure with respect to a vertical center line of the control valve 10. On the other hand, the groove 32 and the hydraulic pressure draining passage 15*b* for connection between the groove 32 and a drain 37 for draining a hydraulic pressure in the retarding hydraulic pressure chamber 12, the groove 33 and the hydraulic pressure draining passage 15*a* for connection between the groove 33 and a drain 36 for draining a hydraulic pressure in the advancing hydraulic pressure chamber 14, and the groove 30 and the hydraulic pressure feeding passage 29 are arranged in a right side in the figure with respect to the vertical center line of the control valve 10.

The foregoing arrangement of the control valve 10 can largely reduce an axial length of the sleeve 23, and still can ensure the sufficient sealing lengths between the openings as described above with reference to FIG. 5.

As appreciated, the present invention is not only applicable to the foregoing type where both the advancing and retarding of the valve timing are performed hydraulically, but also to a type where only the advancing of the valve timing is performed hydraulically.

A spool 24 is slidably received in the sleeve 23. The spool 24 has large-diameter portions or lands 24*a*, 24*b*, 24*c* and 24*d* each having a diameter substantially equal to an inner diameter of the sleeve 23 and small-diameter portions arranged between them. The spool 24 has one end which is in abutting contact with the moving core 22 and the other end which is in abutting contact with a coil spring 25. Accordingly, the spool 24 and the moving core 22 are constantly urged leftward in FIG. 1 by a biasing force of the coil spring 25.

The spool 24 is arranged to displace in proportion to a value of current supplied to the coil 21. Specifically, when the current is supplied to the coil 21, an attraction force is generated at an air gap 28 between the yoke 20 and the moving core 22. This attraction force causes the moving core 22 and thus the spool 24 to move rightward in FIG. 1 against the biasing force of the coil spring 25. On the other hand, when the current supply to the coil 21 is stopped, the moving core 22 and the spool 24 are caused to move leftward by the biasing force of the coil spring 25 so as to return to the state as shown in FIG. 1.

FIG. 1 shows the state where a supply current value to the coil 21 is 0 (zero) and FIG. 2 shows the state where the supply current value is set to a predetermined maximum value. The supply current value is controlled by a control circuit 9

When the supply current value is zero as shown in FIG. 1, the land 24b is set to open the opening 23b with a predetermined clearance A at a right end of the land 24b, while the land 24c is set to open the opening 23c with a predetermined clearance B at a right end of the land 24c.

On the other hand, when the supply current value is maximum as shown in FIG. 2, the land 24b is set to open the opening 23b with a predetermined clearance D at a left end of the land 24b, while the land 24c is set to open the opening 23c with a predetermined clearance C at a left end of the land 24c. The clearance C is set greater than the clearance D.

When the spool 24 moves in the sleeve 23, the lands 24a to 24d of the spool 24 selectively establish and prohibit communication between the corresponding openings 23a to 23e. This changes the communicating conditions of the hydraulic passages 1a and 1d relative to the hydraulic pressure feeding passage 29 and the hydraulic pressure draining passages 15a and 15b so that the hydraulic oil is selectively supplied into or drained from the advancing and retarding hydraulic pressure chambers 14 and 12. Accordingly, hydraulic pressures applied to the opposite sides of the hydraulic piston 8, that is, a differential pressure applied across the hydraulic piston 8, is changed so as to displace the hydraulic piston 8 in the axial direction or hold the hydraulic piston 8 at a desired position.

In general, in the type where both the advancing and retarding operations of the valve timing are hydraulically performed, hydraulic pressures required for performing such operations are defined as follows:

Advancing Operation

Required Hydraulic Pressure=(a pressure corresponding to a dynamic friction of the camshaft)+(a pressure corresponding to a dynamic friction of the hydraulic piston)+(a pressure corresponding to line resistance of the associated passages against the flow of the hydraulic oil)

Retarding Operation

Required Hydraulic Pressure=(a pressure corresponding to a dynamic friction of the hydraulic piston)+(a pressure corresponding to line resistance of the associated passages against the flow of the hydraulic oil)−(a pressure corresponding to a dynamic friction of the camshaft)

Accordingly, the required hydraulic pressures for the advancing and retarding operations are significantly different from each other. Further, when the hydraulic piston 8 is held at a desired intermediate position during linear control thereof, a hydraulic pressure in the advancing hydraulic pressure chamber 14 becomes higher than that in the retarding hydraulic pressure chamber 12 by a pressure corresponding to the driving torque of the camshaft 1.

Figure 7:
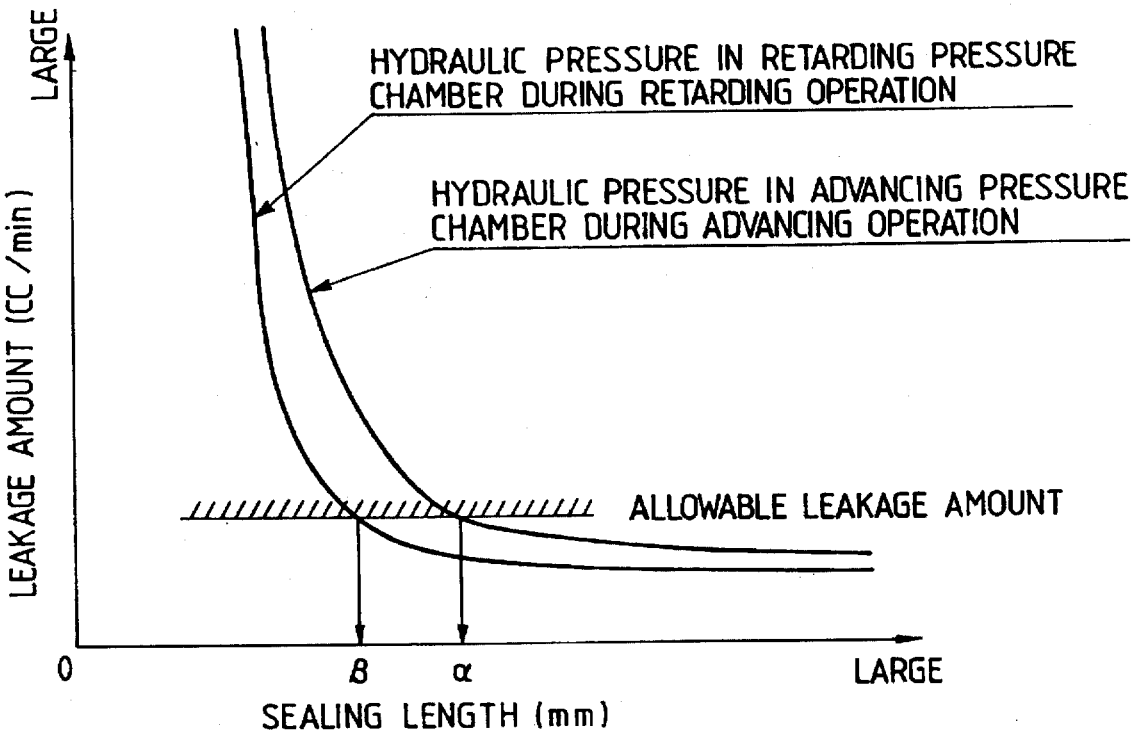
FIG. 7 is a characteristic diagram showing a relationship between the sealing length of the sealing portion of the control valve and a leakage oil amount in terms of differential pressures applied across the sealing portion.

The foregoing required sealing lengths between the openings 23a to 23e are determined based on differential pressures applied across the corresponding sealing portions defined by the spool 24 and the sleeve 23. FIG. 7 shows a relationship between the sealing length and a leakage amount of the hydraulic oil in terms of differential hydraulic pressures applied across the sealing portion. Specifically, since a hydraulic pressure in the advancing hydraulic pressure chamber 14 becomes comparatively higher during the valve timing advancing operation as described above, the sealing length of the sealing portion therefor is required to be relatively greater, while the sealing length of the sealing portion can be set relatively smaller for a hydraulic pressure in the retarding hydraulic pressure chamber 12 during the valve timing retarding operation.

Accordingly, for example, a sealing length of each of the sealing portions between the openings 23a–23b and between the openings 23c–23e may be set to a value $\alpha$, while a sealing length of each of the sealing portions between the openings 23a–23c and between the openings 23b–23d may be set to a value $\beta$, wherein $\alpha>\beta$ since relatively high hydraulic pressures are applied across the sealing portions between the openings 23a–23b and between the openings 23c–23d as compared with those applied across the sealing portions between the openings 23a–23c and between the openings 23b–23d.

On the other hand, in this preferred embodiment, such arrangement of the sealing lengths may not be necessary since the sealing lengths between the openings provided in this preferred embodiment can be set sufficiently greater than $\alpha$ as appreciated from the foregoing description with reference to FIG. 5.

Now, operations of this preferred embodiment will be described hereinbelow.

When the control circuit 9 supplies no current to the coil 21, the spool 24 displaces in the sleeve 23 to a position as shown in FIG. 1. This causes the opening 23a to communicate with the opening 23b and further causes the opening 23c to communicate with the opening 23e. Accordingly, the hydraulic pressure feeding passage 29 communicates with the hydraulic passage 1a, while the hydraulic pressure draining passage 15a communicates with the hydraulic passage 1d. Therefore, the pressurized hydraulic oil is supplied into the retarding hydraulic pressure chamber 12, while the hydraulic oil in the advancing hydraulic pressure chamber 14 is drained.

Accordingly, since the hydraulic pressure in the retarding hydraulic pressure chamber 12 becomes greater than that in the advancing hydraulic pressure chamber 14, the hydraulic piston 8 is displaced leftward as shown in FIG. 1. This leftward movement of the hydraulic piston 8 causes the camshaft 1 to rotate relative to the timing pulley 5 in the valve timing retarding direction so that the valve timing is retarded. As appreciated, FIG. 1 shows the state where the hydraulic piston 8 is moved to the leftmost position due to the hydraulic differential pressure applied thereacross and the camshaft 1 is in the most retarding position for the valve timing.

On the other hand, when the control circuit 9 supplies the given maximum current to the coil 21, the spool 24 displaces in the sleeve 23 to a position as shown in FIG. 2. This causes the opening 23a to communicate with the opening 23c and further causes the opening 23b to communicate with the opening 23d. Accordingly, the hydraulic pressure feeding passage 29 communicates with the hydraulic passage 1d, while the hydraulic pressure draining passage 15b communicates with the hydraulic passage 1a. Therefore, the pressurized hydraulic oil is supplied into the advancing hydraulic pressure chamber 14, while the hydraulic oil in the retarding hydraulic pressure chamber 12 is drained.

Accordingly, since the hydraulic pressure in the advancing hydraulic pressure chamber 14 becomes greater than that in the retarding hydraulic pressure chamber 12, the hydraulic piston 8 is displaced rightward as shown in FIG. 2. This rightward movement of the hydraulic piston 8 causes the camshaft 1 to rotate relative to the timing pulley 5 in the valve timing advancing direction so that the valve timing is advanced. As appreciated, FIG. 2 shows the state where the hydraulic piston 8 is moved to the rightmost position due to the hydraulic differential pressure applied thereacross and the camshaft 1 is in the most advancing position for the valve timing.

On the other hand, when the control circuit 9 supplies a predetermined constant current to the coil 21 to balance the attraction force attracting the moving core 22 and the biasing force of the coil spring 25 with each other, the spool 24 is held in the sleeve 23 at a predetermined intermediate position as shown in FIG. 3. This causes the land 24b to close the opening 23b and further causes the land 24c to close the opening 23c. Accordingly, the hydraulic oil is prohibited from being supplied into and drained from the advancing and retarding hydraulic pressure chambers 14 and 12 so that the hydraulic piston 8 is held at a desired position, for example, as shown in FIG. 3.

As appreciated from the foregoing description, in the first preferred embodiment, since the openings 23a to 23e are arranged in the foregoing offset manner, the sealing lengths between the adjacent openings can be set sufficiently large to ensure the reliable sealing in the control valve 10, while the axial length of the sleeve 23 can be reduced. Accordingly, the valve timing control system according to the first preferred embodiment ensures the good response characteristic during the valve timing advancing or retarding operation and further ensures stably holding the hydraulic piston 8 at the desired position, so that the valve timing can be reliably controlled.

Now, a second preferred embodiment of the present invention will be described hereinbelow with reference to FIGS. 8 and 9.

In the second preferred embodiment, some of the adjacently arranged openings are offset relative to each other by 180 degrees in the circumferential direction of the sleeve 23 and by a given small distance in the axial direction of the sleeve, while others are arranged at the same angular position on the circumference of the sleeve 23 with necessary axial sealing lengths therebetween.

Figure 8:
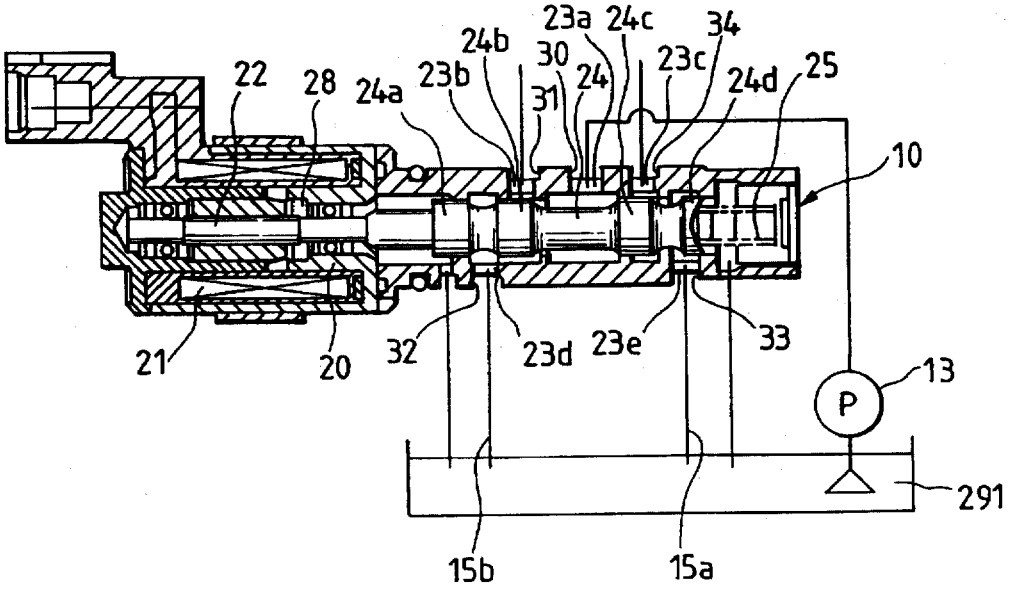
FIG. 8 is a sectional view showing a control valve according to a second preferred embodiment of the present invention.

Specifically, in FIG. 8, the opening 23a connected to the oil pump 13, the opening 23b connected to the retarding hydraulic pressure chamber 12 and the opening 23c connected to the advancing hydraulic pressure chamber 14 are arranged at the same angular position on the circumference of the sleeve 23 with an axial sealing length of $\alpha$ between the openings 23a–23b and with an axial sealing length of $\beta$ between the openings 23a–23c. On the other hand, the openings 23b and 23d are offset relative to each other by 180 degrees in the circumferential direction of the sleeve 23 and by a given small distance in the axial direction of the sleeve 23. Similarly, the openings 23c and 23e are offset relative to each other by 180 degrees in the circumferential direction of the sleeve 23 and by a given small distance in the axial direction of the sleeve 23.

As appreciated, according to the second preferred embodiment, the axial length of the sleeve 23 can be reduced partly, that is, between the openings 23b and 23d and between the openings 23c and 23e, leading to reduction of the axial length of the sleeve 23 on the whole. In this regard, when the adjacently arranged openings of at least one pair are offset relative to each other in the foregoing manner, the axial length of the sleeve 23 can be reduced on the whole.

Figure 9:
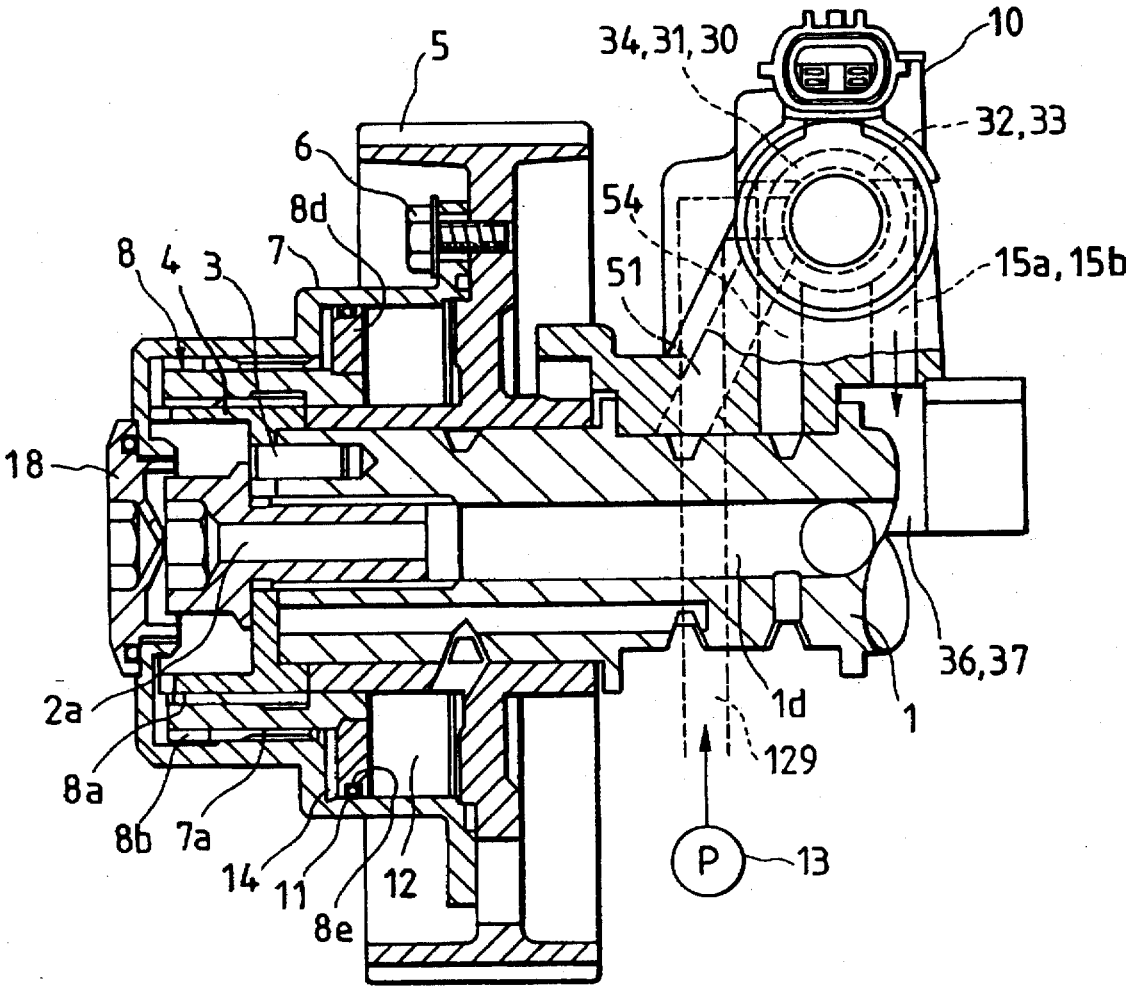
FIG. 9 is a sectional view of a valve timing control system according to the second preferred embodiment, for particularly explaining a positional relationship of openings of the control valve shown in FIG. 8 relative to associated hydraulic passages.

Further, in the second preferred embodiment, as shown in FIG. 9, the hydraulic pressure feeding passage 129 is arranged on a left side in the figure with respect to the vertical center line of the control valve 10, as opposed to the foregoing first preferred embodiment. The other structure is substantially the same as that shown in FIG. 6.

The change in arrangement of the hydraulic pressure feeding passage 129 may be necessitated due to the structure of an engine cylinder head, the structure of the drains of the control valve 10 or others.

It is to be understood that this invention is not to be limited to the preferred embodiments and modifications described above, and that various changes and modifications may be made without departing from the spirit and scope of the invention as defined in the appended claims.

What is claimed is:

1. A valve timing control system for an internal combustion engine comprising:

a valve timing varying mechanism having a pressure chamber for varying a valve timing in response to a pressure in the pressure chamber;

a passage defining member defining a receiving space, the passage defining member also defining a passage connecting the receiving space with the pressure chamber; and a control valve communicating with the pressure chamber for controlling the pressure in the pressure chamber, the control valve comprising:

a cylindrical sleeve disposed in the receiving space of the passage defining member, the sleeve defining a space therein, the sleeve having a pair of openings to the sleeve space arranged on a cylindrical outer periphery of the sleeve, each of the pair of openings being elongate in shape and extending circumferentially about the sleeve over an angular range less than 180 degrees one of the pair of openings for connecting the sleeve space to the passage of the passage defining member and the other of the pair of openings for connecting the sleeve space to one of a pressure source and a pressure drain;

a spool movably disposed in the sleeve space; and an actuator arranged to mechanically operate the spool for moving the spool between a position wherein the pair of openings are connected and a position wherein the pair of openings are disconnected, wherein the pair of openings are arranged at circumferentially opposite sides of the sleeve and are offset axially from each other such that a length of a portion of the sleeve between the pair of openings prevents leakage between the pair of openings when the spool is in the disconnected position.

2. A valve timing control system according to claim 1, wherein the actuator is an electromagnetic actuator having an electromagnetic coil.

3. A valve timing control system according to claim 1, wherein the actuator comprises a connector portion provided asymmetrically relative to an axis of the sleeve.

4. A valve timing control system according to claim 3, wherein the connector portion is arranged at a given reference position on the passage defining member when the sleeve is placed relative to the passage defining member at a given reference position with respect to a rotation direction about the axis of the sleeve.

5. A control valve for controlling a communication state in a hydraulic passage in a hydraulic unit comprising:

a cylindrical sleeve constructed and arranged to be insertable into a receiving space of the hydraulic unit, the sleeve defining a space therein, the sleeve having a pair of openings to the sleeve space arranged on a cylindrical outer periphery of the sleeve, each of the pair of openings being elongate in shape and extending circumferentially about the sleeve over an angular range less than 180 degrees;

a spool movably disposed in the space; and an actuator arranged to mechanically operate the spool for moving the spool between a position wherein the pair of openings are connected and a position wherein the pair of openings are disconnected, wherein the pair of openings are arranged at circumferentially opposite sides of the sleeve and are offset axially from each other such that a length of a portion of the sleeve between the pair of openings prevents leakage between the pair of openings when the spool is in the disconnected position.

6. A control valve according to claim 5, wherein the control valve is connectable to the pressure chamber of a valve timing adjusting mechanism.

7. A valve timing control system according to claim 5, wherein the actuator comprises a connector portion provided asymmetrically relative to an axis of the sleeve.

8. A valve timing control system according to claim 7, wherein the connector portion is arranged at a given reference position on the passage defining member when the sleeve is placed relative to the passage defining member at a given reference position with respect to a rotation direction about the axis of the sleeve.

9. A valve timing control system for an internal combustion engine comprising:

a valve timing varying mechanism having a pressure chamber for varying a valve timing in response to a pressure in the pressure chamber;

a passage defining member defining a receiving space, the passage defining member also defining a passage connecting the receiving space with the pressure chamber; and a control valve communicating with the pressure chamber for controlling the pressure in the pressure chamber, the control valve comprising:

a cylindrical sleeve disposed in the receiving space of the passage defining member, the sleeve defining a space therein, the sleeve having three openings to the sleeve space arranged on a cylindrical outer periphery of the sleeve, each of the openings being elongate in shape and extending circumferentially about the sleeve over an angular range less than 180 degrees, a first opening for connecting the sleeve space to the passage of the passage defining member, a second opening for connecting the sleeve space to a pressure source and a third opening for connecting the sleeve space to a pressure drain;

a spool movably disposed in the sleeve space; and an actuator arranged to mechanically operate the spool for moving the spool between a pressurizing position wherein the first opening is connected to the second opening and an exhausting position wherein the first opening is connected to the third opening, wherein the first opening is arranged on a circumferentially opposite side of the sleeve from the second opening and the third opening, wherein the first opening is offset axially from the second opening and the third opening and wherein the second opening is offset axially from the third opening such that a first length of a portion of the sleeve between the first and second openings prevents leakage between the first and second openings when the spool is in the exhausting position, such that a second length of a portion of the sleeve between the first and third openings prevents leakage between the first and third openings when the spool is in the pressurizing position.

10. A valve timing control system according to claim 9, wherein the actuator comprises a connector portion provided asymmetrically relative to an axis of the sleeve.

11. A valve timing control system according to claim 10, wherein the connector portion is arranged at a given reference position on the passage defining member when the sleeve is placed relative to the passage defining member at a given reference position with respect to a rotation direction about the axis of the sleeve.

12. A valve timing control system for an internal combustion engine comprising:

a valve timing varying mechanism having an advancing pressure chamber and a retarding pressure chamber for varying a valve timing in response to a pressure difference between the advancing pressure chamber and the retarding pressure chamber;

a passage defining member defining a receiving space, the passage defining member also defining a first passage connecting the receiving space with the advancing pressure chamber and a second passage connecting the receiving space with the retarding pressure chamber; and a control valve communicating with the advancing pressure chamber and the retarding pressure chamber for controlling the pressure difference, the control valve comprising:

a cylindrical sleeve disposed in the receiving space of the passage defining member, the sleeve defining a space therein, the sleeve having four openings to the sleeve space arranged on a cylindrical outer periphery of the sleeve, each of the openings being elongate in shape and extending circumferentially about the sleeve over an angular range less than 180 degrees, a first opening for connecting the sleeve space to the first passage of the passage defining member, second opening for connecting the sleeve space to the second passage of the passage defining member, a third opening for connecting the sleeve space to a pressure source and a fourth opening for connecting the sleeve space to a pressure drain;

a spool movably disposed in the sleeve space; and an actuator arranged to mechanically operate the spool for moving the spool between a valve advancing position wherein the first opening is connected to the third opening and the second opening is connected to the fourth opening and a valve retarding position wherein the second opening is connected to third opening and the first opening is connected to the fourth opening, wherein the first opening and the second opening are arranged on a circumferentially opposite side of the sleeve from the third opening and the fourth opening, wherein the first opening and the second opening are offset axially from the third opening and the fourth opening, wherein the first opening is offset axially from the second opening, and wherein the third opening is offset axially from the fourth opening such that a first length of a portion of the sleeve between the first and third openings prevents leakage between the first and third openings when the spool is in the valve retarding position, such that a second length of a portion of the sleeve between the second and third openings prevents leakage between the second and third openings when the spool is in the valve advancing position.

13. A valve timing control system according to claim 12, wherein the actuator comprises a connector portion provided asymmetrically relative to an axis of the sleeve.

14. A valve timing control system according to claim 13, wherein the connector portion is arranged at a given reference position on the passage defining member when the sleeve is placed relative to the passage defining member at a given reference position with respect to a rotation direction about the axis of the sleeve.

* * * * *